US007069211B2

(12) United States Patent
Chiu et al.

(10) Patent No.: US 7,069,211 B2
(45) Date of Patent: Jun. 27, 2006

(54) METHOD AND APPARATUS FOR TRANSFERRING DATA OVER A VOICE CHANNEL

(75) Inventors: Gordon W. Chiu, Coral Springs, FL (US); Daniel J. Landron, Sunrise, FL (US); Vincent Vigna, Miami Springs, FL (US); Chin P. Wong, Coral Springs, FL (US); David R. Heeschen, Coral Springs, FL (US)

(73) Assignee: Motorola, Inc., Schaumburg, IL (US)

( * ) Notice: Subject to any disclaimer, the term of this patent is extended or adjusted under 35 U.S.C. 154(b) by 28 days.

(21) Appl. No.: 10/426,751

(22) Filed: Apr. 30, 2003

(65) Prior Publication Data

US 2004/0220803 A1 Nov. 4, 2004

(51) Int. Cl.
*G10L 11/00* (2006.01)

(52) U.S. Cl. ..... 704/221

(58) Field of Classification Search ..... 704/200–230; 455/466, 446; 370/345, 435; 375/262
See application file for complete search history.

(56) References Cited

U.S. PATENT DOCUMENTS

| | | | | |
|---|---|---|---|---|
| 5,509,031 A * | 4/1996 | Johnson et al. | ..... | 375/262 |
| 5,898,696 A | 4/1999 | Proctor et al. | ..... | 370/468 |
| 6,038,452 A * | 3/2000 | Strawczynski et al. | ..... | 455/446 |
| 6,122,271 A * | 9/2000 | McDonald et al. | ..... | 370/345 |
| 6,144,646 A | 11/2000 | Bohlmann et al. | ..... | 370/311 |
| 6,400,731 B1 | 6/2002 | Nitta | ..... | 370/468 |
| 6,477,176 B1 * | 11/2002 | Hamalainen et al. | ..... | 370/435 |
| 6,631,274 B1 * | 10/2003 | Keshavachar | ..... | 455/466 |

OTHER PUBLICATIONS

Webster's Ninth New Collegiate Dictionary, 1986 by Merriam-Webster, Inc, p. 857.*

Douglas O'Shaughnessy, Speech Communications Human and Machine, Second Edition, 2000 IEEE, Inc., pp. 417-418.*

John R. Deller, Jr., John G. Proakis and John H.L. Hansen, Discrete-Time Processing of Speech Signals, 1987 by Prentice-Hall, Inc., pp. 751-753.*

Yasuyuki Matsuya et al, A 17-bit Oversampling D-to-A Conversion Technology Using Multistage Noise Shaping. vol. 24 No. 4 Aug. 1989.

* cited by examiner

*Primary Examiner*—David D. Knepper
(74) *Attorney, Agent, or Firm*—Scott M. Garrett

(57) ABSTRACT

A voice channel data processor 207 and corresponding method 600 operable in a wireless communications unit's 200 receiver and transmitter to facilitate data transmission on a voice channel includes an encoder 301 for encoding data traffic as a transmit voice frame having a predetermined vocoder parameter and inserting the transmit voice frame into a stream of transmit voice frames with voice traffic and further includes a decoder 303 for parsing a stream of received voice frames to obtain a vocoder parameter for each, comparing the vocoder parameter for each received frame to the predetermined vocoder parameter, routing the received voice frame for processing as data traffic when the comparison is favorable, and otherwise routing the received voice frame for processing as voice traffic.

31 Claims, 4 Drawing Sheets

500

600

METHOD AND APPARATUS FOR TRANSFERRING DATA OVER A VOICE CHANNEL

FIELD OF THE INVENTION

This invention relates in general to communication systems, and more specifically to a method and apparatus for transferring data over a voice channel.

BACKGROUND OF THE INVENTION

Communications systems are known and over time many of these systems and constituent equipment have evolved from analog to digital systems. In digital systems information or traffic in digital form is used to modulate a radio frequency carrier that is used for transmission or transport of the information or traffic. Voice or analog information is converted to and from a digital form using vocoders prior to transmission. Using these approaches enables more services to more users with the same or less bandwidth and at lower costs.

Many presently deployed or legacy systems are largely devoted to voice traffic and many systems that are and are being deployed use a voice channel with a corresponding unique air interface for voice traffic and a separate data channel and corresponding air interface for data traffic. A wireless communications unit, such as some legacy units only support voice channels or only a voice channel or data channel at any one time. The marketplace is beginning to express a need for data transport of small amounts of data at the same time as a voice channel or circuit is maintained. Clearly a need exists for a method and apparatus for transferring data over a voice channel, preferably in a fashion that is transparent to legacy units.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION OF PREFERRED EMBODIMENT

Figure 1:
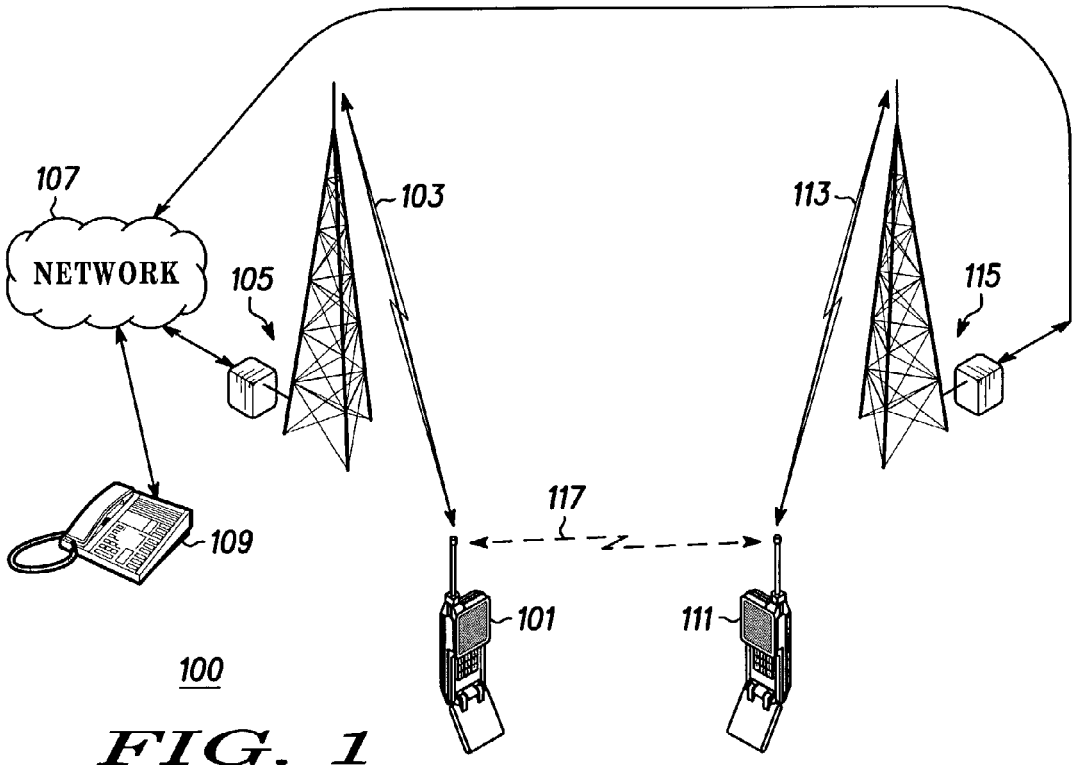
FIG. 1 depicts, in a simplified and representative form, a diagram of a communications system that will be used to explain an environment for the preferred embodiments in accordance with the present invention.

In overview, the present disclosure concerns communications systems that provide service to communications units or more specifically users thereof operating therein. More particularly various inventive concepts and principles embodied in methods and apparatus for transferring data over a voice channel to and from a wireless communications unit where the voice channel is maintained are discussed and described. The communications systems and equipment of particular interest are those that have been or are being deployed, such as Integrated Digital Enhanced Networks, GSM (Global System for Mobile communications) systems, or the like and evolutions thereof that rely on voice channels for transferring voice traffic and use vocoders for transcoding such voice traffic for transport over the air.

As further discussed below various inventive principles and combinations thereof are advantageously employed to encode data as a voice frame that from outward appearances looks like a voice frame with voice traffic in a manner that allows a voice frame with data to be distinguished at a receiving communications unit, thereby providing a way of embedding data in a voice channel without affecting legacy units or infrastructure equipment. This will alleviate various problems, such as infrastructure updates or obsolescence of legacy equipment and devices that can be associated with known approaches and facilitate the realization of data communications on existing systems provided these principles or equivalents thereof are utilized.

The instant disclosure is provided to further explain in an enabling fashion the best modes of making and using various embodiments in accordance with the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms, if any, such as first and second, top and bottom, and the like are used solely to distinguish one from another entity or action without necessarily requiring or implying any actual such relationship or order between such entities or actions.

Much of the inventive functionality and many of the inventive principles are best implemented with or in software programs or instructions and integrated circuits (ICs) such as application specific ICs. It is expected that one of ordinary skill when guided by the concepts and principles disclosed herein will be readily capable of generating such software instructions and programs and ICs with minimal experimentation. Therefore, in the interest of brevity and minimization of any risk of obscuring the principles and concepts in accordance to the present invention, further discussion of such software and ICs, if any, will be limited to the essentials with respect to the principles and concepts of the preferred embodiments.

Referring to FIG. 1, a simplified and representative diagram of a communications system will be used to explain an environment for the preferred embodiments. FIG. 1 shows a communications unit, preferably a wireless communications unit 101, such as a cellular handset or subscriber device, messaging device, or other device equipped for operation in a wireless communications system that supports a voice channel. The communications unit is coupled via the radio signal 103 to infrastructure 105, including a base station, etc that is further coupled to a network 107. The infrastructure, network 107 a public switched telephone network or Internet, and their interface and interaction are generally known. Also shown coupled to the network is a telephone, such as an Internet Protocol phone. A further communications unit 111 supports a voice channel and is coupled, via radio signal 113, to infrastructure 115 and thus the network 107. Furthermore the communications units 101, 111 are potentially in direct communications via radio signal 117.

The communications units and infrastructure are suitable for engaging in communications via a voice channel in that audible information is transferred or transported from one to another using voice frames that are provided by a vocoder.

Specifically as is known speech is converted via a vocoder to a stream of voice frames and the stream of voice frames is converted by another vocoder to speech.

These voice frames are channel coder and transported or transferred via an over the air protocol that is not relevant to this disclosure. This air interface protocol may be a Time Division Multiple Access protocol as in Integrated Digital Enhanced Network and GSM systems or any other suitable air interface access technology.

Communications from communications unit 101 to communications unit 111 that passes through the network does not require transcoding (conversion to and from speech for the connection from infrastructure 105 to infrastructure 115). As will be discussed further below this allows a preferred embodiment to be implemented without any changes to the infrastructure. Communications from one of the communications unit to and from the IP phone 109 will likely require transcoding or conversion from one code (voice frames) to another code such as IP frames or packets.

Figure 2:
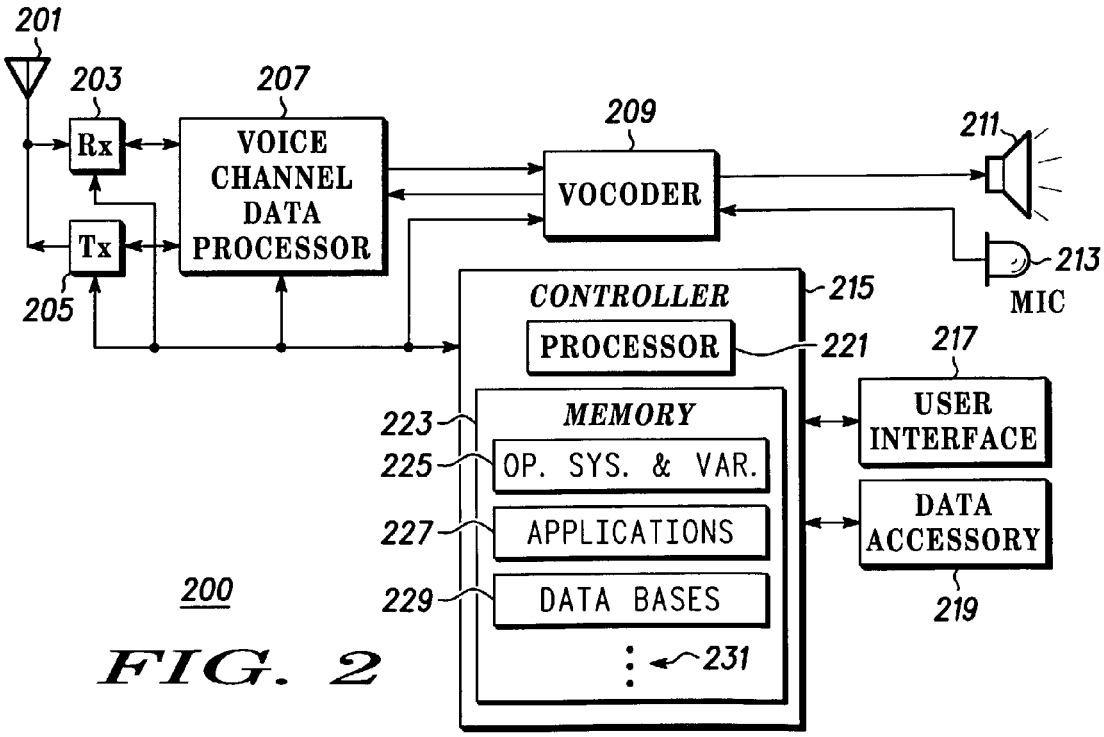
FIG. 2 depicts, in a simplified and representative form, a block diagram of a wireless communications unit including a voice channel data processor according to the present invention.

Referring to FIG. 2, a simplified and representative block diagram of a communications unit 200 or wireless communications unit, such as a cellular handset and the like, including a voice channel data processor will be discussed and described. The communications unit 200 is similar to and can be used as the communications unit 101, 111 in FIG. 1. The communications unit includes a known antenna 201 that is coupled to a receiver 203 and transmitter 205 that are as well known. The receiver function is generally known and in this environment as in most wireless environments operates and is operable to receive a signal, such as radio signals 103, 117 or 113, 117 where these radio signals include data on a voice channel. The receiver performs various other generally known functions, such as, down conversion, synchronization, and various functions that may be air interface technology specific, such as decoding etc in order to provide a voice frames or specifically a stream of voice frames. The voice frames or stream of voice frames is advantageously coupled to a voice channel data processor 207 that may be viewed as part of the receiver or as part of the transmitter and that will be further discussed below. The transmitter 205 is generally known and responsible for or used for transmitting data on a voice channel or more specifically processing voice frames from the voice channel data processor where certain of the voice frames are encoded data to add forward error correction and other duties that are access and system specific, and converting the resultant signals to radio signals and sending or transmitting the radio signals via the antenna 201 on the uplink channel to the infrastructure.

The voice channel data processor in addition to being coupled to the receiver 203 is coupled to the transmitter 205 and to and from a conventional vocoder 209. The vocoder 209 is preferably a known linear predictive coding vocoder that operates to convert voice frames to speech and drive via an amplifier and filter arrangement (not shown) a speaker or earpiece 211. In addition the vocoder converts speech from a microphone 213 as amplified and filtered to voice frames that are then coupled back to the voice channel data processor 207 and from there to the transmitter 205. Thus the vocoder may be viewed as part of the transmitter.

The receiver 203, transmitter 205, voice channel data processor 207, and vocoder 209 are inter coupled to a controller 215 that operates to provide general control for the communications unit and these functions as is largely known excepting for the inventive principles and concepts that will be provided in further detail below. The controller 215 is further coupled to and drives and is responsive to a conventional user interface 217 including, for example, a display and keypad. Additionally the controller may be coupled to an external data accessory, such as a lap top computer, personal digital assistant, or the like. The controller 215 can assist with, facilitate or aid, or perform much of the functionality of the voice channel data processor 207 depending on implementation specifics and design choices given the description below. The controller 215 includes a processor 221 that is one or more known microprocessors and digital signal processor (DSP) such as one of the HC 11 family of microprocessors or 56000 family of DSPs available from Motorola, Inc. of Schaumburg, Ill. This processor is likely responsible for various duties, such as base band receive and transmit call processing, error coding and decoding and the like. The processor 221 is inter coupled to or may include a memory 223 with operating software in object code form, data and variables 225 that when executed by the processor controls the wireless communications unit, including the receiver 203, transmitter 209, and voice channel data processor 207, vocoder 209, etc. Further included in the memory are, for example, various applications 227, databases 229 such as phone books, address books, appointments, and the like, as well as other software routines 231 that are not here relevant, but that will be obvious to one of ordinary skill as useful if not necessary in order to effect a general purpose controller for a communications unit.

Figure 3:
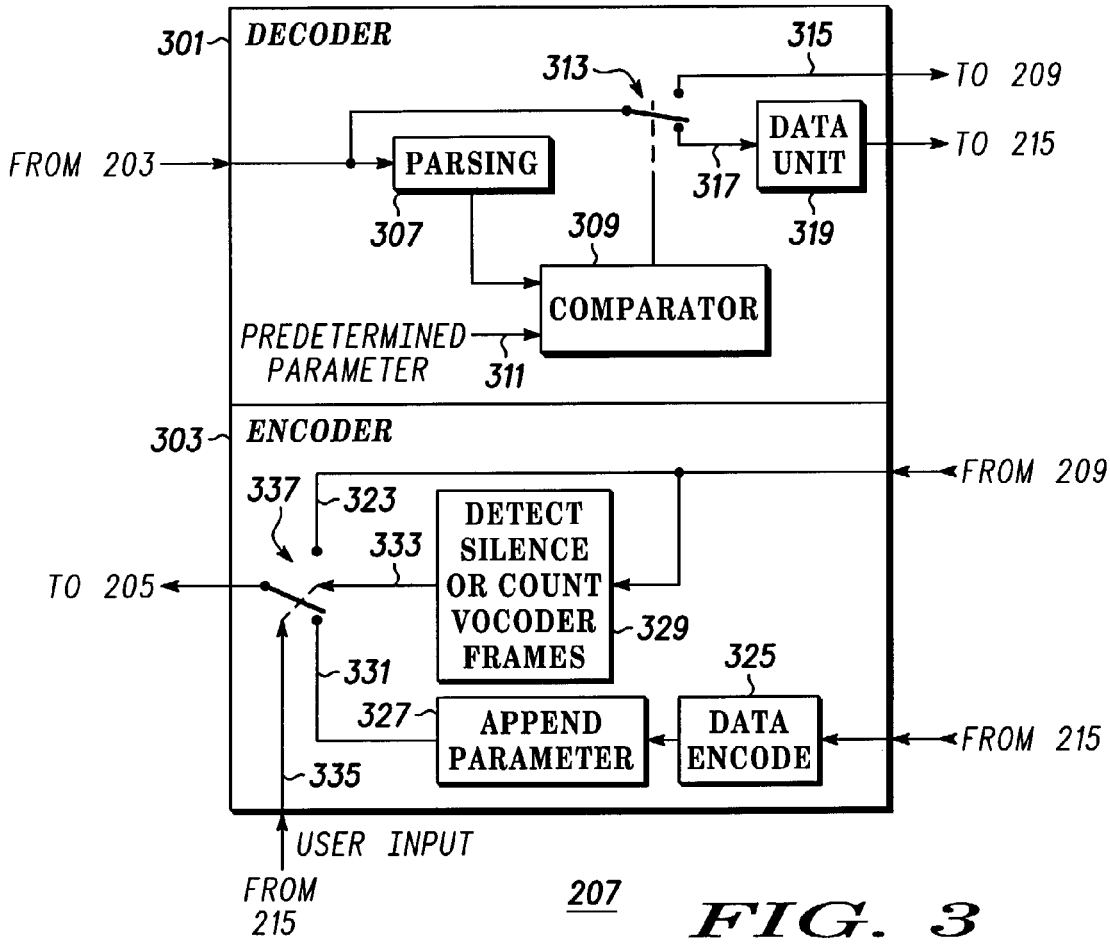
FIG. 3 illustrates a more detailed block diagram of the voice channel data processor that can be used in the FIG. 2 communications unit.

Referring to FIG. 3, a more detailed block diagram of the voice channel data processor that can be used in the FIG. 2 communications unit, specifically as part of the receiver 203 or transmitter 205, will be discussed and described. The simplified block diagram of FIG. 3 is suitable for showing the functionality of the voice channel data processor 207. This functionality can be implemented as dedicated circuitry or as part of the resources of the processor 221 or some combination depending on design specifics and the like. Preferably, given sufficient spare capacity as much as possible is implemented using the processor 221 or a DSP (not shown) devoted to receive and transmit signal processing, such as decoding and error correction and protection.

The voice channel data processor 207 is operable in a communications unit or wireless communications unit, to facilitate data transmission on a voice channel. The voice channel data processor comprises a decoder 301 and encoder 303. The decoder 301 is coupled to as stream of voice or received voice frames from the receiver 203 and these are coupled to a parser 307 for parsing each of the frames in the stream of received voice frames to obtain a vocoder parameter for each received voice frame. The vocoder parameter for each received voice frame is coupled to a comparator 309 and compared to a predetermined vocoder parameter to provide a comparison where the comparison is used to control a switch 313. The comparison controls the switch 313 to route the received voice frame for processing as data traffic 317 at a data unit 319 when the comparison is favorable, and to route the received voice frame for processing as voice traffic 315 at the vocoder 209 when the comparison is not favorable.

The encoder 303 is coupled, at one terminal 323 of a switch337, to a sequence or stream of voice frames or transmit voice frames from the vocoder 209. The encoder 303 is also coupled to data from the controller 215 or other data source (not shown) and operates to or is enabled for encoding data traffic as a transmit voice frame or plurality of such voice frames at the data encoder 325. Then the appending unit 327 is operable for appending or including in each of the transmit voice frames a predetermined vocoder parameter or plurality of such parameters. Thus a voice frame or frames with data traffic encoded and the predetermined parameter(s) is supplied at terminal 331 of the switch 337. The switch 337 operates to insert the transmit voice frames with data into a stream of transmit voice frames with voice traffic.

The switch 337 can be controlled in one or more of the following manners. First the switch can be responsive to a user input at 335 either directly or indirectly via the controller 215. Suppose a user of the communications device decides to send a name and phone number to a calling party and so indicates with a key stroke or pattern of keystrokes. The controller 215 can send the data to the encoder and control the switch 337 to insert the voice frame with the date at terminal 331 at the appropriate time(s) and thus the encoder inserts the transmit voice frame(s) with data (name and phone number) into the stream of transmit voice frames with voice traffic from the vocoder responsive to the user input. Note that since the user knows that data is being sent they can be quiet for a brief period or alternatively the controller can essentially mute the vocoder or force a silent frame.

Alternatively the encoder can insert one or more of the transmit voice frames into the stream of transmit voice frames with voice traffic in lieu of transmit voice frames with voice traffic that is silence. Note that most vocoders, especially for portable equipment where battery life is a concern, detect silence on the part of the user and simply do not generate voice frames when there is silence. Thus insertion of a voice frame with data and the predetermined vocoder parameter can be a simple as detecting the absence of a transmit voice frame at function 329, controlling the switch 337 at control input 333, and thereby inserting one or more voice frames with data in lieu of this absence.

One other approach to the issue of where to insert a voice frame with data is to steal a voice frame spot or position from the vocoder provided voice frames with voice traffic from time to time. In this instance the encoder 303 encodes the data traffic as a plurality of the transmit voice frames each including the predetermined vocoder parameter and inserts a portion of the plurality of the transmit voice frames each including the predetermined vocoder parameter at equally spaced positions within the stream of transmit voice frames with the voice traffic. Here the function 329 counts the vocoder provided voice frames and preferably periodically ignores or drops one, controls the switch and in its place inserts a voice frame with data and the special or predetermined vocoder parameter. Note in this instance the insertion will be at a low enough frequency so as not to generate too much of an audio disturbance due to the resultant transmit voice frame stream. For example some estimates suggest that one in twenty or so frames could be stolen with data carrying voice frames inserted with acceptable levels of voice quality maintained at receiving units.

The predetermined vocoder parameter or vocoder parameter that is used by the comparator 309 and that is appended by the appending function 327 is preferably a vocoder parameter having a low probability of occurrence, such as less than 1 in 1000 or preferably less than 1 in 1,000,000 in a valid voice frame. The particular selection of a parameter or plurality of parameters will depend on the vocoder technique or technology. In an LPC vocoder using one of more of a voiced parameter or an energy parameter and setting these parameters to legitimate values for a valid voice frame has provided satisfactory results. The voiced parameter is a measurement of the extent or degree of voicing in a speech waveform, where voicing for example is a sound with a tonal or pitch frequency, such as a vowel and the like. The energy parameter is a measurement of the energy in a speech waveform.

Thus for example and preferably if the predetermined parameter is set or selected to be a combination of the voiced parameter set to specify a high degree of voicing and the energy parameter set to specify a low average signal power or energy it is expected that this combination would occur with low probability in actual speech since voiced sounds always have energy. Simulations suggest that less than 1 in 1,000,000 voice frames show this combination of a high degree of voicing and low energy. Furthermore, when legacy communication units, without the ability to distinguish voice frames with data, route this voice frame with these vocoder parameters to their vocoders there is little output from the vocoder and no annoyance or audible artifacts to the user due to the low energy parameter. Additionally there is no need to change or modify infrastructure to support communications unit to communications unit communications since no transcoding occurs when these calls are routed through the network.

Figure 4:
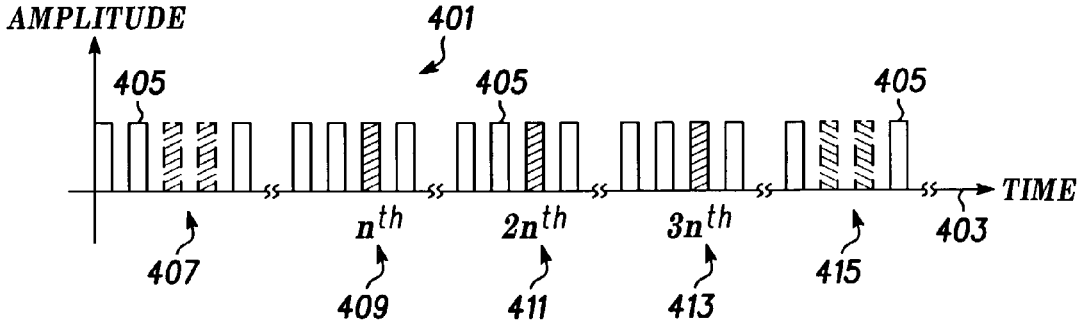
FIG. 4 depicts a data stream structure for use in the FIG. 3 voice channel data processor.

Referring now to FIG. 4, a data stream structure for use in the FIG. 3 voice channel data processor will be discussed and described. FIG. 4 shows a stream of voice frames 401 as a function of time 403 where there are voice frames with voice traffic 405 (solid outline, no fill), voice frames with data encoded 407 (dotted outline with a rising cross hatch) that have been inserted in areas where silence or no voice frame was detected, and voice frames with data 409, 411, 413 (solid outline with rising pattern) that have been inserted in a stolen location, specifically every nth slot or position, namely the nth, 2nth, and 3nth slots, and voice frames with data 415 (dotted outline with a falling pattern) that have been inserted responsive to a user request.

The voice frame rate in an Integrated Digital Enhanced Network is 33⅓ voice frames per second. As we will see from the discussion of FIG. 5 each frame is suitable for 117 bits of data and thus if one frame in 20 is used for data a data rate of just under 200 bits per second can be supported over the voice channel in this system.

Figure 5:
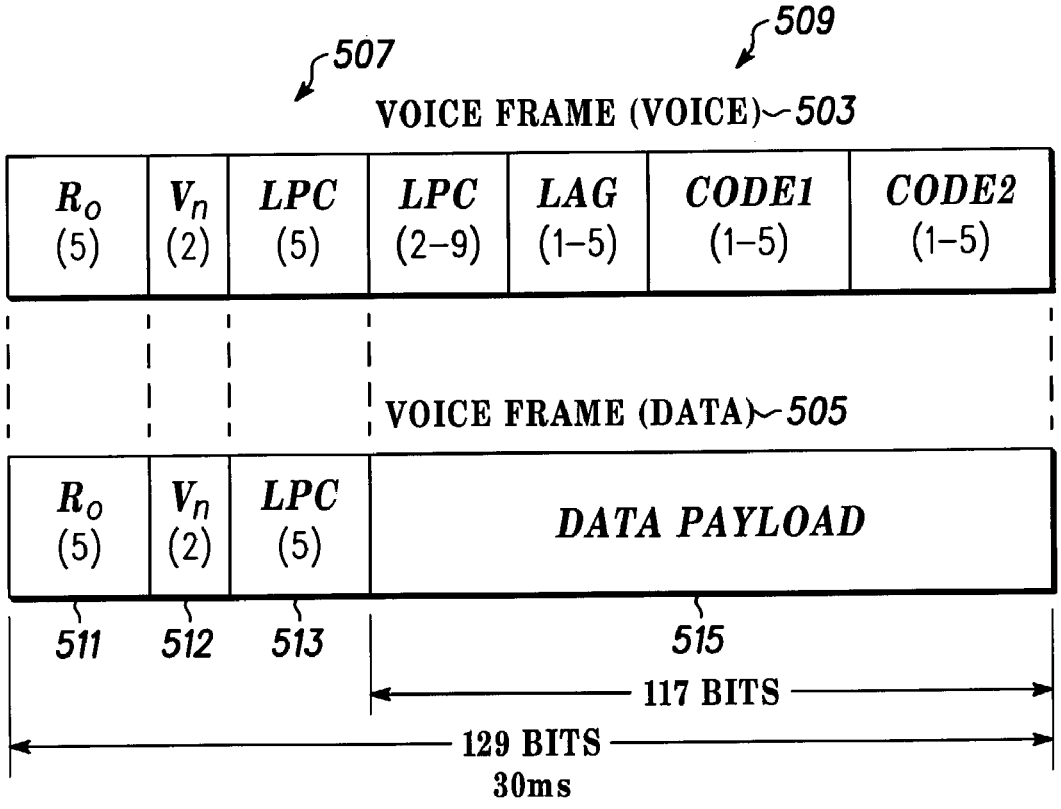
FIG. 5 illustrates a data structure of a voice frame for use in the FIG. 3 voice channel data processor.

Referring to FIG. 5, a data structure of a voice frame for use in the FIG. 3 voice channel data processor will be discussed and described. FIG. 5 depicts one voice frame 500 that may be utilized as a voice frame with voice traffic 503 under normal circumstances or as a voice frame with data or data traffic 505, when or as needed. In one embodiment of a linear predictive coding (LPC) vocoder, these voice frames are provided or processed at the rate of one for each 30 millisecond time period, where each frame is 129 bits in length.

The voice frame provided or processed by the vocoder 503 includes vocoder parameters 507, specifically: Ro, a 5 bit indication of energy or power or average power associated with the voice frame; Vn, a 2 bit indication of a degree of voicing associated with the speech frame; LPC1, a 5 bit version of the first coefficient for the polynomial model of the voice track used by the vocoder; LPC2-9, which are the balance of the coefficients in the voice track model; and LAG1-5, which are lag coefficients calculated for the vocoder model. The voice frame with voice traffic also includes code1 (1-5) and code2 (1-5), which are excitation vectors for the vocoder model. The balance 509 of 117 bits are used for the LPC2-9, LA1-5, and excitation vectors with the specifics somewhat dependent on a particular implementation and not relevant for our discussions.

In a preferred embodiment, the voice frame with data 505 looks like any other voice frame, however in properly equipped communications units or receivers, since certain of the vocoder parameters or predetermined vocoder parameters will be set to predetermined or known values with low probability of occurrence in an actual speech frame, such units can be enabled or constructed to recognize a voice frame that is or is with virtual certainty carrying data or application data. More specifically in one embodiment Ro 511 is set to "0" or a very low energy or power level and Vn 512 is set to "3" or a very strong degree of voicing, which is a situation that simulations show occurs less than 1 in 1,000,000 chances. Additionally in a further embodiment LPC1 513 is set "0" as well. With these vocoder parameters set as indicated a legacy unit that treats this voice frame with data as a voice frame with voice and processes it with a vocoder will not generate any audible quirks or artifacts that are objectionable or likely even noticeable to a user of the legacy unit. With these three vocoder parameters set as specified the voice frame with data 505 still has 117 bits for a data payload 515. Because of the forward error correction that already exists in most systems, for example as part of a channel coding process, to protect voice frames from a vocoder most or all of this payload can be devoted to actual data. Thus a system where one out of twenty (20) voice frames on average was devoted to data traffic, could support an average data rate of just less than 200 bits/second. If silence was used for the data traffic and a user is silent on average 33% of the time the average data rate would be in approximately 1300 bits/second.

Thus we have disclosed and discussed a communications unit 200 comprising a communications receiver for receiving data on a voice channel and a communications transmitter. The communications receiver comprises the receiver 203 for receiving a signal comprising a voice frame and the voice channel data processor 207, coupled to the receiver, and further including a parser for parsing the voice frame to obtain a vocoder parameter; a comparator for comparing the vocoder parameter to a predetermined parameter to provide a comparison; and a data unit for processing the voice frame as data traffic when the comparison is favorable.

In the preferred form the communications receiver further comprising a vocoder for processing the voice frame as voice traffic when the comparison is not favorable. Preferably the communications receiver, when the data unit processes the voice frame as data traffic, will repeat results or audio or regenerate audio of a previous voice frame that the vocoder processed as voice traffic.

The comparator is further for comparing the vocoder parameter obtained from the paring process to a predetermined parameter having a low probability of occurrence in a valid voice frame. In one embodiment the predetermined parameter is a voiced parameter or an energy parameter for the valid voice frame that result from a LPC vocoder. The voiced parameter specifies or is set to a high degree of voicing and the energy parameter specifies or is set to a low average signal power.

Also, so long as the comparison is favorable, the voiced frame can be one of a plurality of equally spaced frames each of the plurality of equally spaced frames processed as additional data traffic. The voice frames with data traffic may include data traffic such as a phone number, a name, an address, an appointment time or data, directions to an address, or a short text message.

The communications transmitter is operable to transmit data on a voice channel, and comprises a vocoder for processing a voice signal and generating a plurality of voice frames with voice traffic; a voice channel data processor for encoding data traffic as one or more voice frames, each further including a predetermined vocoder parameter and inserting the voice frame into the plurality of voice frames with voice traffic; and a transmitter amplifier and signal processor, coupled to the voice channel data processor, for transmitting a signal comprising the voice frame and the plurality of other voice frames with voice traffic.

The predetermined vocoder parameter is selected as above described with a low probability of occurrence in a valid voice frame. The voice channel data processor can encode the data traffic as a plurality of the voice frames each including the predetermined vocoder parameter and insert a portion of the plurality of the voice frames each including the predetermined vocoder parameter at, on average, equally spaced positions within the plurality of voice frames with the voice traffic. The rate of insertion is such that the inverse of an average time between a first and a second portion of the plurality of the voice frames including the data traffic is a low frequency. For example, suppose 1 out of every 20 of the voice frames is a frame with data the frequency of insertion would be 1⅔ frames per second given the frame rate of 33⅓ frames per second in one embodiment.

The voice channel data processor can as earlier discussed insert the voice frame with the data into the plurality of voice frames with voice traffic in lieu of a voice frame with voice traffic that is silence and this may be a location for a voice frame where the frame is absent or the frame with date can be inserted into the plurality of voice frames with voice traffic responsive to a user input. The data may take many forms such as the earlier mentioned phone number or list, a name, an address, an appointment time and data, directions to an address, or a short text message and the like. Advantageously, the voice frame payload is highly protected so most of this payload can be devoted to data rather than overhead for error correction and the like.

Figure 6:
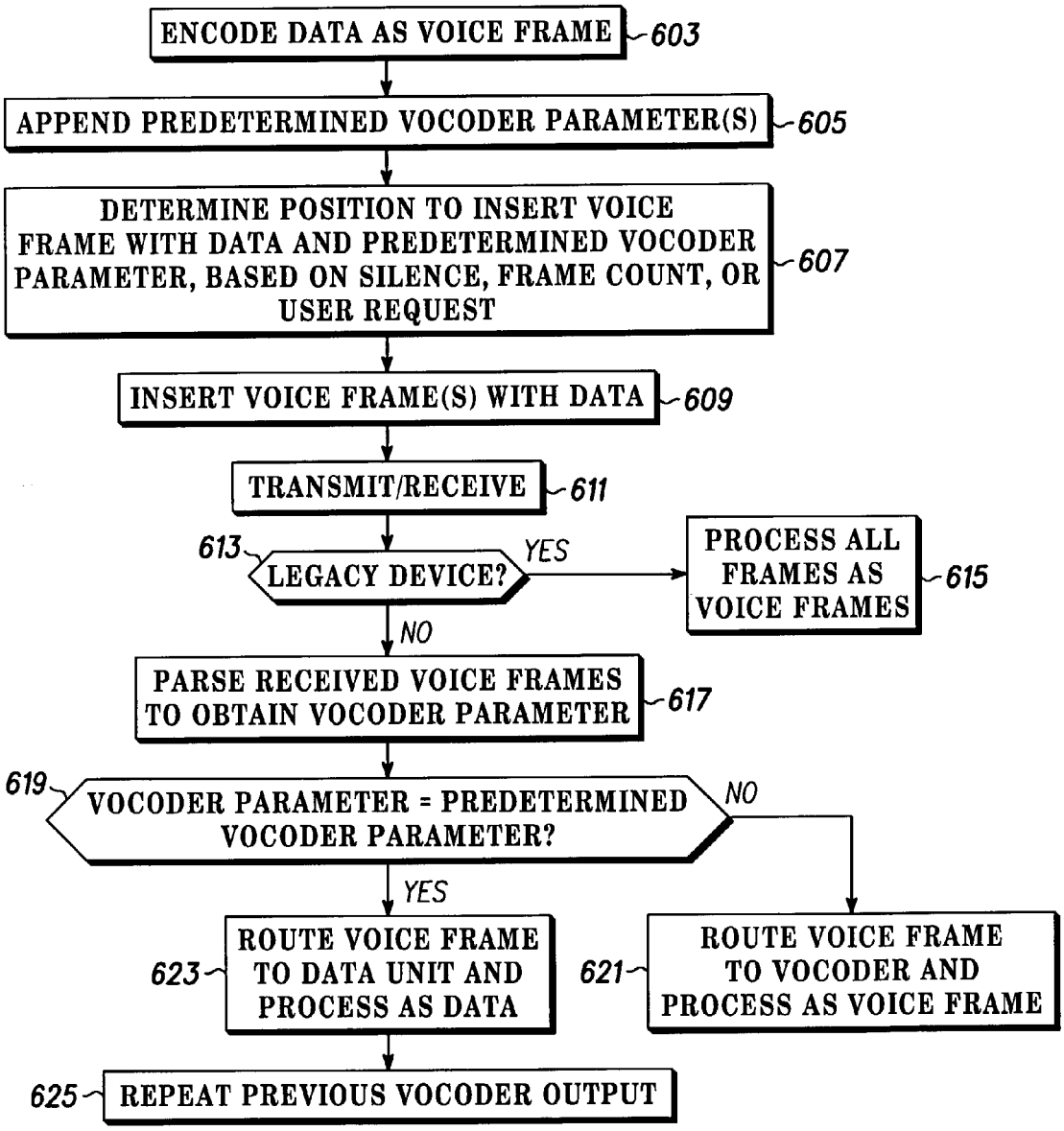
FIG. 6 is a flow chart of a preferred method embodiment of generating and identifying data on a voice channel.

Referring to FIG. 6 a flow chart of a preferred method embodiment of generating and identifying data on a voice channel will be discussed and described. Some of this discussion will be a review of the concepts and principles discussed above. The method depicted in FIG. 6 may be implemented with the structure noted above or other appropriate structures. The method of FIG. 6 can be performed in a communications unit or specifically a transmitter in one communications unit and a receiver in another unit and is a method 600 for facilitating data transfers, e.g. generating and identifying data on or over a voice channel.

The method comprises encoding data or data traffic as a voice frame or portion of a voice frame at 603 and then at 605 appending a predetermined vocoder parameter(s) to complete a voice frame with the special or predetermined vocoder parameters. Then at 607 a location or position to insert the voice frames with data into a voice frame stream from a vocoder is undertaken. This position may be responsive to a user input, or based on a frame count or a silent frame detection. The voice frame with the data is inserted into the voice frame stream at 609. At 611 the voice frame stream with the voice frame including data is transmitted from one communications unit and received at another such unit. If the communications unit is a legacy unit 613, e.g. not equipped to identify the voice frame with data the voice frame is processed according to standard techniques by a vocoder as a voice frame with voice traffic at 615.

If at 613 the communications unit is not a legacy unit then 617 parsing the voice frames to obtain a vocoder parameter for each frame. Next at 619 this vocoder parameter is compared to a predetermined parameter, such as a high degree of voicing and a low energy level that has a low probability of occurrence in a valid voice frame to provide a comparison. When this comparison is not favorable at 619 the voice frame is routed to a vocoder and processed as voice traffic 621 to provide an audio signal to drive the earpiece. When the comparison is favorable at 619 the voice frame is routed to a data unit and processed as data traffic 623. When a voice frame is routed to the data unit the vocoder can be instructed to repeat the previous vocoder output as indicated at 625.

The processes, apparatus, and systems, discussed above, and the inventive principles and concepts thereof can alleviate problems, such as annoying audio quirks and equipment obsolescence caused by alternative proposals to carry data on a voice channel. Using these principles of identifying a voice frame as a voice frame carrying data by using low probability vocoder parameters or characteristics and then judiciously inserting this voice frame with data in a voice frame stream will facilitate data transfer or transport over a voice channel with no noticeable audio problems and with the added advantages of the data availability. Using the inventive principles and concepts disclosed herein advantageously provides for data transfer during the course of a normal conversation without annoying anyone including those with legacy units that are not suited or arranged to take advantage of the data transfer, thus providing data services to users who require it without forcing either legacy unit owners or carriers to upgrade equipment, which will be beneficial to users and providers a like.

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. A method in a communications receiver for identifying data on a voice channel, the method comprising:

receiving a signal comprising a voice frame, the voice frame including a payload and at least one vocoder parameter;

parsing the voice frame to obtain the at least one vocoder parameter; and comparing the at least one vocoder parameter to a predetermined parameter to provide a comparison, wherein when the comparison indicates the at least one vocoder parameter is the same as the predetermined parameter the voice frame is processed as data traffic and when the comparison indicates otherwise, the voice frame is processed as voice traffic.

2. The method of claim 1 wherein the comparing further comprises comparing the at least one vocoder parameter to a predetermined parameter having a low probability of occurrence in a valid voice frame.

3. The method of claim 2 wherein the predetermined parameter includes at least one of a voice parameter and an energy parameter for the valid voice frame.

4. The method of claim 3 wherein the voice parameter specifies a strong degree of voicing and the energy parameter specifies a low average signal power.

5. The method of claim 1 wherein, when the comparison indicates the at least one vocoder parameter is equal to the predetermined parameter, the voice frame is one of a plurality of equally spaced frames, each of the plurality of equally spaced frames are processed as additional data traffic.

6. The method of claims 1 wherein, when the voice frame is processed as data traffic, results of a previous voice frame that was processed as the voice traffic are repeated at a speaker.

7. A communications receiver for receiving data on a voice channel, the communications receiver comprising:

a receiver for receiving a signal comprising a voice frame, the voice frame including at least one vocoder parameter;

a voice channel data processor, coupled to the receiver, further including:

a parser for parsing the voice frame to obtain the at least one vocoder parameter, a comparator for comparing the at least one vocoder parameter to a predetermined parameter to provide a comparison; and a data unit for processing the voice frame as data traffic when the comparison indicates the at least one vocoder parameter is the same as the predetermined parameter.

8. The communications receiver of claim 7, further comprising a vocoder for processing the voice frame as voice traffic when the comparison indicates the at least one vocoder parameter is not the same as the predetermined parameter.

9. The communications receiver of claim 8, wherein, when the data unit processes the voice frame as data traffic, results of a previous voice frame that the vocoder processed as the voice traffic are repeated by the vocoder at a speaker.

10. The communications receiver of claim 7, wherein the comparator is further for comparing the at least one vocoder parameter to a predetermined parameter having a low probability of occurrence in a valid voice frame.

11. The communications receiver of claim 10 wherein the predetermined parameter is one of a voiced parameter or an energy parameter for the valid voice frame.

12. The communications receiver of claim 11 wherein the voiced parameter specifies a high degree of voicing and the energy parameter specifies a low average signal power.

13. The communications receiver of claim 7 wherein, when the comparison indicates the at least one vocoder parameter is the same as the predetermined parameter, the voiced frame is one of a plurality of equally spaced frames, each of the plurality of equally spaced frames are processed as additional data traffic.

14. The communications receiver of claim 7, wherein the data unit processes the voice frame as data traffic, the data traffic includes one of a phone number, a name, an address, and appointment time and data, directions to an address, or a short text message.

15. A communications transmitter operable to transmit data on a voice channel, the communications transmitter comprising:

a vocoder for processing a voice signal and generating a plurality of voice frames with voice traffic;

a voice channel data processor for encoding data traffic as a voice frame including a predetermined vocoder parameter for indicating the voice frame includes data traffic, and for inserting the voice frame including the predetermined vocoder parameter into the plurality of voice frames with the voice traffic; and a transmitter amplifier, coupled to the voice channel data processor, for transmitting a signal comprising the voice frame including the predetermined vocoder parameter and the plurality of other voice frames with voice traffic.

16. The communications transmitter of claim 15 wherein the predetermined vocoder parameter is a vocoder parameter having a low probability of occurrence in a valid voice frame.

17. The communications transmitter of claim 16 wherein the predetermined vocoder parameter is one of a voiced parameter or an energy parameter for a valid voice frame.

18. The communications transmitter of claim 17 wherein the voiced parameter specifies a high degree of voicing and the energy parameter specifies a low average signal power.

19. The communication transmitter of claim 15 wherein, the voiced channel data processor encodes the data traffic as a plurality of voice frames each including the predetermined vocoder parameter and inserts a portion of the plurality of the voiced frames each including the predetermined vocoder parameter at equally spaced positions within the plurality of voice frames with the voice traffic.

20. The communications transmitter of claim 19 wherein the inverse of an average time between a first and a second portion of the plurality of the voice frames including the date traffic is a low frequency, whereby voice squality is not affected.

21. The communications transmitter of claim 15 wherein the voice channel data processor inserts the voice frame including the predetermined vocoder parameter into the plurality of voice frames with voice traffic in lieu of a voice frame with voice traffic that is silence.

22. The communications transmitter of claim 21 wherein the voice frame with voice traffic that is silence is the absence of a voice frame.

23. The communications transmitter of claim 21 wherein the voice channel data processor insert the voice frame including the predetermined vocoder parameter into the plurality of voice frames with voice traffic responsive to a user input.

24. The communications transmitter of claim 15 wherein the voice channel data processor encodes the data traffic into one or more voice frames each including the predetermined vocoder parameter and wherein the data traffic further comprises one of a phone number, a name, an address, an appointment time and date, directions to an address, and a short text message.

25. A voice channel data processor operable in a wireless communications unit, to facilitate data transmission on a voice channel, the voice channel data processor comprising:

an encoder for;

encoding data traffic as a transmit voice frame including a predetermined vocoder parameter, and inserting the transmit voice frame including the predetermined vocoder parameter into a stream of transmit voice frames with voice traffic; and a decoder for;

parsing a stream of received voice frames to obtain a vocoder parameter for each received voice frame, comparing the vocoder parameter for each received voice frame to the predetermined vocoder parameter to provide a comparison, routing the received voice frame for processing as data traffic when the comparison indicates the vocoder parameter is the same as the predetermined vocoder parameter, and routing the received voice frame for processing as a voice traffic when the comparison indicates the vocoder parameter is not the same as the predetermined vocoder parameter.

26. The voice channel data processor of claim 25 wherein the predetermined vocoder parameter is a vocoder parameter having a low probability of occurrence in a valid voice frame.

27. The voice channel data processor of claim 26 wherein the predetermined vocoder parameter is one of a voiced parameter or an energy parameter for the valid voice frame.

28. The voice channel data processor of claim 27 wherein the predetermined vocoder parameter specifies a high degree of voicing and the energy parameter specifies a low average signal power.

29. The voice channel data processor of claim 27 wherein, the encoder encodes the data traffic as a plurality of voice frames, each of the plurality of voice frames including the predetermined vocoder parameter, and wherein the encoder inserts a portion of the plurality of the voiced frames including the predetermined vocoder parameter at equally spaced positions within the stream of transmit voice frames with the voice traffic.

30. The voice channel data processor of claim 25 wherein the encoder inserts the transmit voice frame including the predetermined vocoder parameter into the stream of transmit voice frames with voice traffic in lieu of a transmit voice frame with voice traffic that is silence.

31. The voice channel data processor of claim 30 wherein the encoder inserts the transmit voice frame including the predetermined vocoder parameter into the stream of transmit voice frames with voice traffic responsive to a user input.

* * * * *